US010302311B2

(12) United States Patent
Hill et al.

(10) Patent No.: US 10,302,311 B2
(45) **Date of Patent: *May 28, 2019**

(54) INTAKE DRAIN SYSTEM AND METHOD

(71) Applicant: Johnson Controls Technology Company, Holland, MI (US)

(72) Inventors: Terry E. Hill, Goddard, KS (US); Robert E. Cabrera, Wichita, KS (US); Greg K. Reaser, Wichita, KS (US)

(73) Assignee: Johnson Control Technology Company, Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/487,196

(22) Filed: Apr. 13, 2017

(65) Prior Publication Data

US 2017/0219218 A1 Aug. 3, 2017

Related U.S. Application Data

(63) Continuation of application No. 14/618,961, filed on Feb. 10, 2015, now Pat. No. 9,631,821.

(60) Provisional application No. 61/941,981, filed on Feb. 19, 2014.

(51) Int. Cl.

| | |
|---|---|
| ***F23L 1/00*** | (2006.01) |
| ***F24D 19/08*** | (2006.01) |
| ***F24D 5/04*** | (2006.01) |
| ***F24H 9/16*** | (2006.01) |

(52) U.S. Cl.

CPC ..... *F24D 5/04* (2013.01); *F23L 1/00* (2013.01); *F24D 19/08* (2013.01); *F24H 9/16* (2013.01); *Y10T 29/4935* (2015.01); *Y10T 29/49348* (2015.01)

(58) Field of Classification Search

CPC ..... F24D 19/08; F24D 19/00; F24D 5/04
USPC ..... 126/116 R, 85 B, 85 R; 122/52
See application file for complete search history.

(56) References Cited

U.S. PATENT DOCUMENTS

| | | | | |
|---|---|---|---|---|
| 2,886,247 | A * | 5/1959 | Arbogast | F16T 1/00 237/9 R |
| 4,479,482 | A * | 10/1984 | Cherington | F24H 8/006 126/99 R |
| 4,558,689 | A * | 12/1985 | McCann | F24H 3/065 126/109 |
| 4,682,579 | A * | 7/1987 | Bigham | F24H 8/006 126/110 R |
| 4,934,335 | A | 6/1990 | Marlatt | |
| 5,117,653 | A * | 6/1992 | Kil | F24F 13/22 62/291 |
| 5,313,930 | A | 5/1994 | Kujawa et al. | |

(Continued)

FOREIGN PATENT DOCUMENTS

| | | |
|---|---|---|
| CN | 203782790 U | 8/2014 |

*Primary Examiner* — Gregory L Huson
*Assistant Examiner* — Nikhil P Mashruwala
(74) *Attorney, Agent, or Firm* — Fletcher Yoder, P.C.

(57) ABSTRACT

A furnace system includes an air intake that includes a pipe portion and a seal component configured to couple with the pipe portion. The furnace system also includes an internal drain disposed internal to the air intake. The internal drain includes a trough configured to collect liquid flowing along an inner surface of the pipe portion. The internal drain also includes an opening in the trough configured to guide the liquid collected in the trough to a passage through the air intake to a location outside the air intake.

22 Claims, 9 Drawing Sheets

(56) References Cited

U.S. PATENT DOCUMENTS

| | | | | |
|---|---|---|---|---|
| 5,704,343 | A * | 1/1998 | Ahn | F24H 8/006<br>126/110 R |
| 6,536,378 | B2 | 3/2003 | Lyons | |
| 2016/0174611 | A1 | 6/2016 | Monsees et al. | |
| 2018/0135885 | A1 * | 5/2018 | Shaffer | F24H 4/04 |

* cited by examiner

INTAKE DRAIN SYSTEM AND METHOD

CROSS REFERENCE TO RELATED APPLICATIONS

This application is a continuation of U.S. patent application Ser. No. 14/618,961, filed Feb. 10, 2015, entitled "INTAKE DRAIN SYSTEM AND METHOD," which claims priority from and the benefit of U.S. Provisional Application Ser. No. 61/941,981, filed Feb. 19, 2014, entitled "INTAKE DRAIN SYSTEM AND METHOD," both of which are hereby incorporated by reference.

BACKGROUND

The present disclosure relates generally to furnaces systems, and more specifically, to drains for air intake pipes included in furnace systems.

A wide range of applications exists for furnace systems, including residential, commercial, and industrial applications. For example, a residential furnace system may include a combustion chamber and heat exchanger to produce hot air to heat an enclosed space such as a living room, a bedroom, a bathroom, or some other residential room. Generally, furnace systems operate by combusting a mixture of air and fuel from a fuel source in a combustion chamber to produce combustion products. The combustion products may pass through coils or piping in a heat exchanger. Air may pass through the heat exchanger and blow over the coils or piping, such that the air extracts heat from the combustion products passing through the coils or piping. The hot air is exported from the heat exchanger into an area (e.g., a room) for heating. The combustion products may exit the heat exchanger through an exhaust stack, where the combustion products are released into an open space (e.g., atmosphere).

Furnace systems may include electronics and electronic wiring for various purposes (e.g., an electronic igniter and associated electronic wiring for igniting fuel in the combustion chamber). Additionally, portions of the furnace system may be cooled by an external environment or an adjacent air conditioning unit, such that condensation may be formed on components of the furnace system. It is now recognized that such condensation may impact system operation. For example, the condensation may accumulate and flow such that it comes into contact with system electronics. Accordingly, it is now recognized that there is a need for protecting system features (e.g., electronics) from damage associated with condensation on certain system features.

DRAWINGS

DETAILED DESCRIPTION

The present disclosure is directed to furnace systems and drains for air intake pipes included in furnace systems. An air intake pipe may be included in a furnace system to import air into a combustion chamber to facilitate combustion. The air may be a part of a mixture ignited in the combustion chamber to produce combustion products in the process of heat generation. The mixture may also include a fuel from a fuel source. The combustion products generated in the combustion chamber may be routed through one or more passages (e.g., coils or piping) in a heat exchanger to facilitate heat exchange with a medium (e.g., air) that will be utilized to warm a particular area (e.g., a room). Specifically, for example, the combustion products may be routed through coils of a heat exchanger and a fan may blow air over the coils of the heat exchanger. Thus, the air blown over the coils may extract heat from the combustion products passing through the coils, and the heated air may be exported to a load (e.g., an enclosed room) for warming the load. Combustion products may be exported from the furnace system via any of various removal systems. For example, a combustion air blower may blow the combustion products into an area away from the furnace system or a chimney may guide the combustion products to an external environment.

The mixture in the combustion chamber described above may be ignited via an electronic igniter. Additionally, there may be other components of the furnace system that include electronics (e.g., a user display or user interface). In some embodiments, the air intake pipe may be located adjacent to and, in particular, above, electronic components of the furnace system (e.g., the electronic igniter). Further, the air intake pipe may be disposed proximate evaporator coils of an air conditioning unit, which may cool the air intake pipe when the air conditioning unit is in use. Thus, the air intake pipe may be susceptible to collecting liquid (e.g., condensation) within the air intake pipe, especially during seasons when the air conditioner unit may be in use (e.g., summer). In other embodiments, the furnace system may be located away from an air conditioning unit but in a cool basement, such that certain components of the furnace system may become cool and collect condensation. In either case, as described above, the air intake pipe may be susceptible to collecting liquid within the air intake pipe in a location that makes other features of the system vulnerable to damage from the accumulated liquid, such as directly above electronic components of the furnace system. Thus, an internal drain for the air intake pipe (e.g., a drain internal to the air intake pipe) may block or deter liquid from accumulating in undesirable locations and dripping out of the air intake pipe and onto electronic components of the furnace system.

Figure 1:
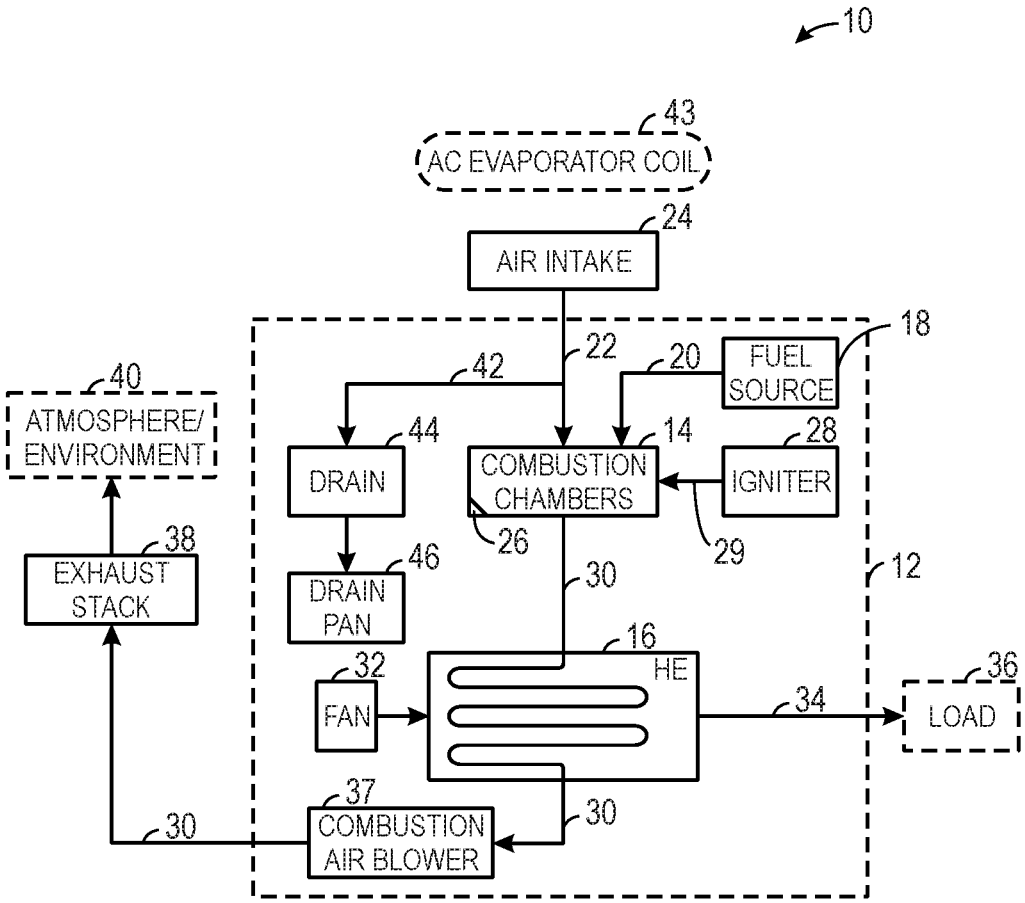
FIG. 1 is a schematic block diagram of a furnace system in accordance with an embodiment of the present disclosure.

Turning now to the figures, FIG. 1 illustrates a schematic block diagram of a furnace system 10 in accordance with present embodiments. The furnace system 10 may include an integrated vessel 12 that includes a combustion chamber 14 and a heat exchanger 16, among other components, inside the integrated vessel 12. In another embodiment, the combustion chamber 14 and the heat exchanger 16 may be disposed in separate vessels, in which case the combustion chamber 14 and heat exchanger 16 may be connected by piping or conduit. In the present embodiment, a fuel source 18 may provide fuel 20 to the combustion chamber. The fuel 20 may include natural gas, liquefied petroleum gas, fuel oil, coal, wood, or the like.

In the illustrated embodiment, air 22 may be provided to the combustion chamber 14 via an air intake 24. The air 22 and the fuel 20 may be mixed to produce a mixture 26 inside the combustion chamber 14. The mixture 26 may include a certain ratio of air 22 and fuel 20, such that the mixture 26 is suitable for efficient combustion. The mixture 26 in the combustion chamber 14 may be ignited via an igniter 28. The igniter 28 may be an electronic igniter, which includes electronics (e.g., electronic wiring). A pulse may be sent through electronic wiring of the igniter 28 to instruct the igniter 28 to produce a spark 29 adjacent to or within the combustion chamber 14. The spark 29 may ignite the mixture 26 inside the combustion chamber 14 to produce combustion products 30. In other embodiments, different types of igniters may be used.

The combustion products 30 may pass through coils in the heat exchanger 16. A fan 32 or some other flow-motivating device may force a medium (e.g., air) over the coils in the heat exchanger 16 to generate a heated medium by transferring heat from the combustion products to the medium. In the illustrated embodiment, the fan 32 operates to blow air over the coils to generate hot air 34, and the hot air 34 may be exported to a load 36 (e.g., a room) for heating the load 36. It should be noted that the fan 32 in the illustrated embodiment is shown separate from the heat exchanger 16 and blowing over the heat exchanger 16 to generate the hot air 16. In another embodiment, the fan 32 may be located inside the heat exchanger 16 (e.g., a vessel of the heat exchanger 16) and may operated to blow the air directly over the coils of the heat exchanger 16, as previously described.

Combustion products 30 passing through the coils of the heat exchanger 16 may pass to a combustion air blower 37. The combustion air blower 37 may be configured to pull the combustion products 30 from the coils in the heat exchanger 16 and blow the combustion products 30 through an exhaust stack 38 (e.g., a chimney) into atmosphere 40, or some area external to the furnace system 10. In some embodiments, the combustion products 30 may be removed in a different manner. For example, the combustion products 30 may be allowed to naturally flow out of the exhaust stack 38 without a motivating device.

Often, as previously described, furnace systems 10 may be susceptible to collecting liquid (e.g., moisture, humidity, or condensation) in piping and other components of the furnace system 10. For example, the air intake 24 may be susceptible, especially during summer months, to collecting liquid or condensation 42 due to cooling from air conditioning (AC) evaporator coils 43 of an air conditioning unit resting atop the furnace system 10 and in close proximity to the air intake 24. Thus, in accordance with embodiments of the present disclosure, an internal drain 44 may be used in the air intake 24 for draining condensation 42 collected inside the air intake 24. In the illustrated embodiment, the internal drain 44 may drain the condensation 42 to a drain pan 46, which may drain to another area or drain external to the furnace system 10. The drain pan 46 may also be used for collecting other liquids (e.g., from combustion products 30) from other portions of the furnace system 10.

Figure 2:
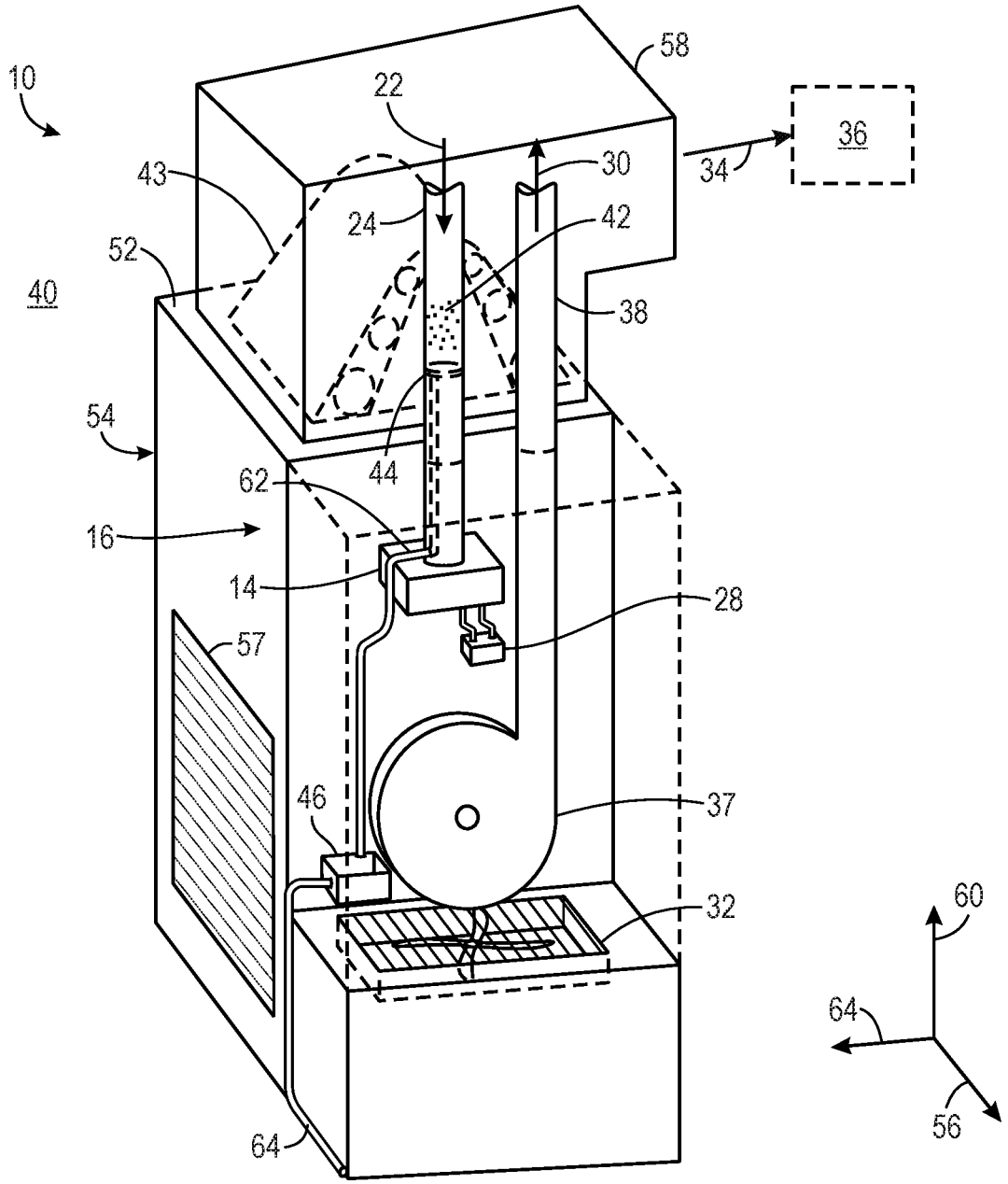
FIG. 2 is a perspective view of a furnace system in accordance with an embodiment of the present disclosure.

In FIG. 2, a partial cutaway perspective view of an embodiment of the furnace system 10 is shown. Also included in the illustrated embodiment are the evaporator coils 43 of an air conditioning unit. In the illustrated embodiment, the evaporator coils 43 are positioned on a top surface 52 of a rectangular vessel 54 of the furnace system 10, adjacent to the air intake 24 and the exhaust stack 38.

As previously described, the air intake 24 may import air 22 into the combustion chamber 14. Fuel from a fuel source (not shown) may also be imported into the combustion chamber 14 for generating the mixture suitable for combustion in the combustion chamber 14. The igniter 28 may be wired to the combustion chamber 14 and may provide a spark for igniting and combusting the mixture in the combustion chamber 14. In the illustrated embodiment, the combustion products 30 generated by combustion in the combustion chamber 14 are guided through coils of the heat exchanger 16 toward the back of the vessel 54 in a direction generally opposite that indicated by arrow 56. The fan 32 in the vessel 54 of the illustrated embodiment draws air through an opening 57 in the vessel 54 and causes the air to flow over the coils of the heat exchanger 16 to produce hot air 34 as previously described, and the hot air 34 is routed through a duct 58 toward the load 36 (e.g., room) for heating the load 36. It should be noted that, in the illustrated embodiment, the fan 32 is generally even with a bottom of the opening 57. However, in other embodiments, the fan 32 may be located below the opening 57, above the opening 57, or even with the opening 57, or in any other area of the vessel 54, so long as the fan 32 draws air through the opening 57 and causes the air to pass over the coils in the heat exchanger 16, as described above.

The combustion products 30 are routed from an exit of the coils of the heat exchanger 16 toward the combustion air blower 37, which may be configured to draw the combustion products 30 from the coils. The combustion products 30 are blown via the combustion air blower 36 upwardly in a direction generally indicated by arrow 60, through the exhaust stack 38 (e.g., chimney), and into the atmosphere 40. In another embodiment, the combustion products 30 may be blown via the combustion air blower 36 in some other direction in accordance with a flow passageway of the exhaust stack 38 in order to reach the exhaust stack 38. In other words, the combustion air blower 36 may blow the combustion products 30 in whichever direction generally conforms with the direction of the exhaust stack 38.

As previously described, the furnace system 10 may include the internal drain 44 for draining condensation 42 from the air intake 24. In particular, the internal drain 44 may drain condensation 42 formed inside the air intake 24 due to cooling of the air intake 24 by the evaporator coils 43 of the air conditioning unit, as previously described. The internal drain 44 in the illustrated embodiment collects and drains the condensation 42 internal to the air intake 24. In the illustrated embodiment, tubing 62 of the internal drain 44 routes the condensation 42 away from the combustion chamber 14, e.g., in a direction generally indicated by arrow 64, then downwardly opposite the direction generally indicated by arrow 60 and toward the drain pan 46. The tubing 62 in the illustrated embodiment is disposed external to the combustion chamber 14. Condensation 42 travels through the tubing 62, which may be disposed within a portion of the air intake 24, to an area outside of the air intake 24. The condensation 42 may be deposited in the drain pan 46. Contents in the drain pan 62 may be gravity fed through an opening in a bottom portion of the drain pan 62 to additional tubing 64, which may lead to a floor drain or some other area or drain external to the furnace system 10.

Figure 3:
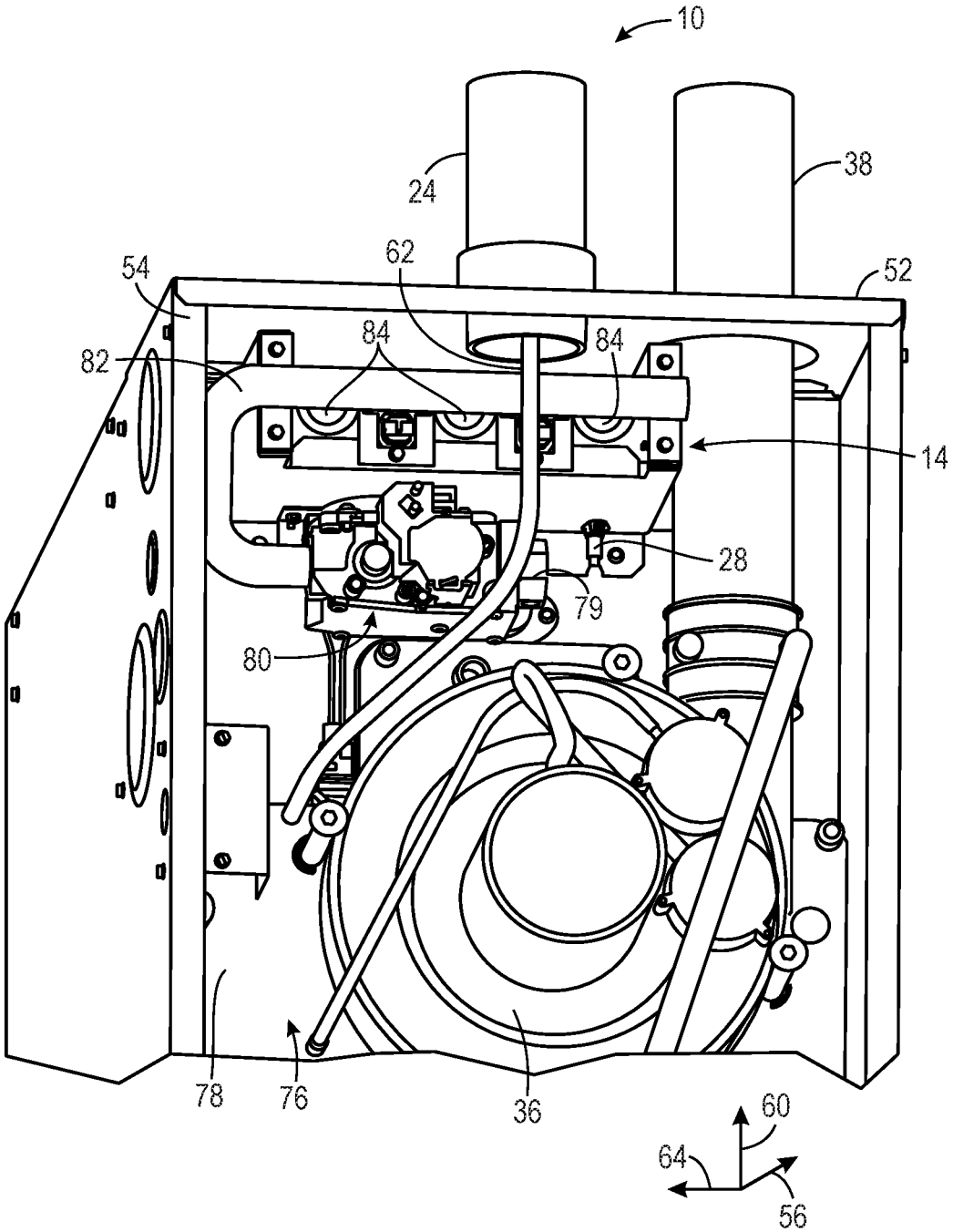
FIG. 3 is a perspective view of a portion of a furnace system in accordance with an embodiment of the present disclosure.

A portion of an embodiment of the furnace system 10 is shown in a partial cutaway perspective view in FIG. 3. In the illustrated embodiment, the portion of the furnace system 10 shown includes the combustion air blower 36, the air intake 24, the exhaust stack 38, the tubing 62 of the internal drain 44, the igniter 28, and the combustion chamber 14. All of the illustrated components listed above, in the illustrated embodiment, are disposed in an enclosure 76 of the vessel 54. The enclosure 76 in the illustrated embodiment may be separated by an interior wall 78 of the furnace system 10.

In the illustrated embodiment, a fuel intake line of a separate fuel source 18 (not shown) may be coupled to a fuel inlet 79 of a control valve 80 of the furnace system 10. The control valve 80 may open to enable fuel 20 to route through a fuel header 82. The fuel header 82 is configured to distribute fuel through openings (not shown) in the fuel header 82 into the combustion chamber 14. The fuel may be distributed to burners 84 in the combustion zone. The burners 84 may collect the fuel-air mixture 26, as previously described, and combust the mixture 26. The burners 84 may be connected to coils in the heat exchanger 16 of the vessel 54. The heat exchanger 16 may route the combustion products 30 through the coils in the vessel 54 on the other side of the interior wall 78 (e.g., generally opposite the direction indicated by arrow 56). As previously described, the fan 32 may also be on the other side of the interior wall 78, and may blow air over the coils of the heat exchanger 16 to extract heat from the combustion products 30. The hot air 34 may then be exported to the load 36 (e.g., the room) for heating the load 36.

In the illustrated embodiment, the tubing 62 of the internal drain 44 routes condensation 42 formed inside of the air intake 24 downwardly in a direction generally opposite the direction indicated by arrow 60, and then back through the internal wall 78 of the furnace system 10. The internal drain 44 may route the condensation 42 through the internal wall 78 to the drain pan 46 located adjacent to the internal wall 78. The drain pan 46 may be located adjacent to, and on the other side, of the internal wall 78, such that the drain pan 46 is capable of collecting liquid combustion products flowing through the coils in the heat exchanger 16 toward the combustion air blower 36 by way of some other drain mechanism (e.g., a drain in the coils of the heat exchanger 16). The condensation 42 from the internal drain 44 (and the liquid combustion products) may be deposited in the drain pan 46, and the drain pan 46 may be gravity or suction drained (e.g., drained out of a hole in the bottom of the drain pan 46) through additional tubing 64 (not shown here) to a floor drain external to the furnace system 10. It should be noted that the particular orientation of the furnace system 10 in the illustrated embodiments are meant as non-limiting examples of the orientation of the furnace system 10. For example, the furnace system 10 may be oriented upwards, as shown, or the furnace system 10 may be oriented horizontal left, horizontal right, or even downwards. To accommodate different orientations, the air intake 12 may be disposed on a side of the furnace system 10 such that the air intake 12 is generally exposed to the environment 40.

Figure 4:
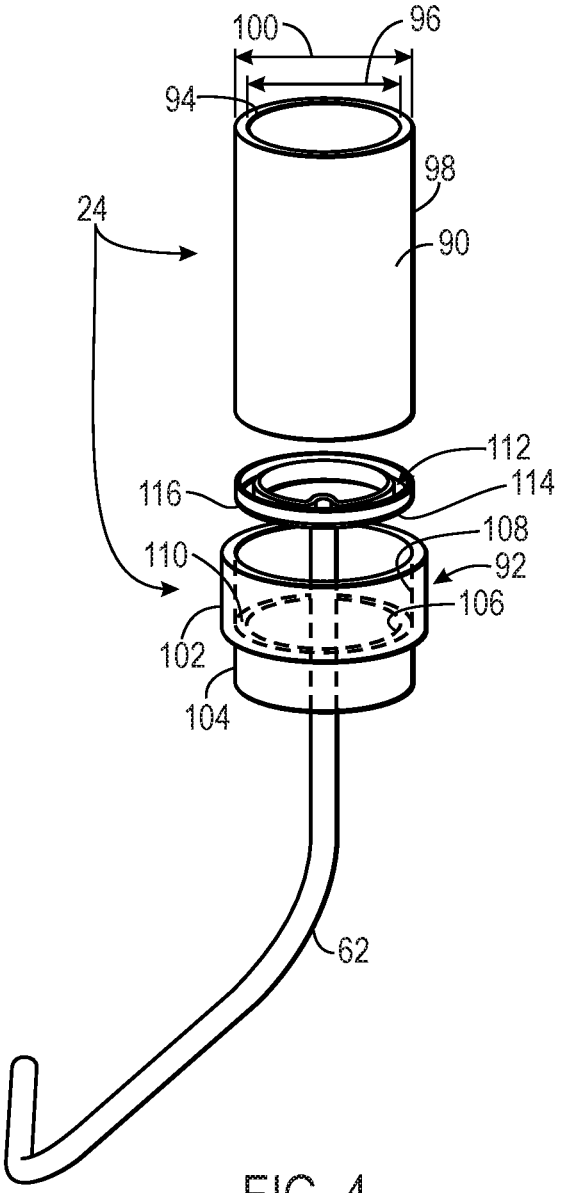
FIG. 4 is an exploded perspective view of an air intake pipe with an internal drain in accordance with an embodiment of the present disclosure.

An embodiment of the internal drain 44 with the tubing 62, along with a portion of the air intake 24, is shown in an exploded perspective view in FIG. 4. The air intake 24 in the illustrated embodiment includes a cylindrical pipe portion 90 and a cylindrical seal component 92. The pipe portion 90 may include an inner surface 94 with an inner diameter 96 and an outer surface 98 with outer diameter 100. The seal component 92 may be an internal seal and may include two portions, an upper cylinder 102 and a lower cylinder 104 (e.g., upper and lower segments), which are coupled together. In some embodiments, the seal component 92 may include additional piping extending downwardly from the upper cylinder 102 and the lower cylinder 104. The upper cylinder 102 and the lower cylinder 104 may be coupled via an adhesive, or the two cylinders 102, 104 of the seal component 92 may be a single part.

In the illustrated embodiment, an inner surface 106 of the lower cylinder 104 may have a smaller diameter than an inner surface 108 of the upper cylinder 102. Accordingly, the lower cylinder 104 may include a horizontal lip 110 (e.g., an internal ledge) exposed inside of the air intake 24 that extends from the inner surface 106 of the lower cylinder 104 radially outward to the inner surface 108 of the upper cylinder 102. The horizontal lip 110 may be configured to support a trough 112 of the internal drain 44, such that the trough 112 is disposed between the pipe portion 90 and the seal component 92 (e.g., internal seal) along a flow path of the air intake 24. In other words, a bottom surface 114 (e.g., base) of the trough 112 may contact and may seal against the horizontal lip 110 of the lower cylinder 104, such that the bottom surface 114 of the trough 112 is positioned between the horizontal lip 110 and the pipe portion 90. Additionally, a circumferential outer surface 116 of the trough 112 may contact and may seal against the inner surface 108 of the upper cylinder 102. Accordingly, the trough 112 of the internal drain 44 may be retained inside the seal component 92 of the air intake 24. In some embodiments, the entire internal drain 44 may be disposed inside the pipe portion 90. It should be noted that positional and geometric terms are used in a general sense throughout the present disclosure. For example, the terms horizontal, vertical, parallel, perpendicular and so forth are meant to be relative and indicative of a general orientation or configuration, not as rigid mathematical relationships.

Additionally, in the illustrated embodiment, the pipe portion 90 of the air intake 24 fits into the upper cylinder 102 of the seal component 92. The outer surface 98 of the pipe portion 90 may contact the inner surface 108 of the upper cylinder 102. The outer surface 98 and the inner surface 108 may seal together via a friction fit, or an adhesive may be used to enhance the seal. In either configuration, the pipe portion 90 of the air intake 24 is disposed above the trough 112 of the internal drain 24. Additionally, the trough 112 may extend radially inward more so than the inner diameter 96 of the inner wall 94 of the pipe portion 90. In other words, the inner wall 94 of the pipe portion 90 may be aligned above and between inner edges of walls defining the trough 112. As such, the condensation 42 formed in the air intake 24 (e.g., due to cooling of the air intake 24 from an evaporator coil of an air conditioner adjacent to the air intake 24) may fall into, and be collected by, the trough 112 below the pipe portion 90, and be drained internal to the seal component 92 of the air intake 24 through tubing 62 of the internal drain 44. As described above, the seal component 92 may include an additional pipe extending downwardly from the upper and lower cylinders 102, 104, such that the tubing 62 may extend downwardly internal to the additional pipe of the seal component 92. The tubing 62 may exit the additional pipe, such that the condensation 42 may be drained to an area external to the air intake 24 (e.g., to the drain pan 46). It should be noted that, in some embodiments, the trough 112 may be sized such that it can be directly disposed within the pipe portion 90. In such embodiments, the outer surface 116 of the trough 112 may engage the inner surface 94 of the pipe portion 90 to facilitate flow of the condensation 42 through the internal drain 44.

Figure 5:
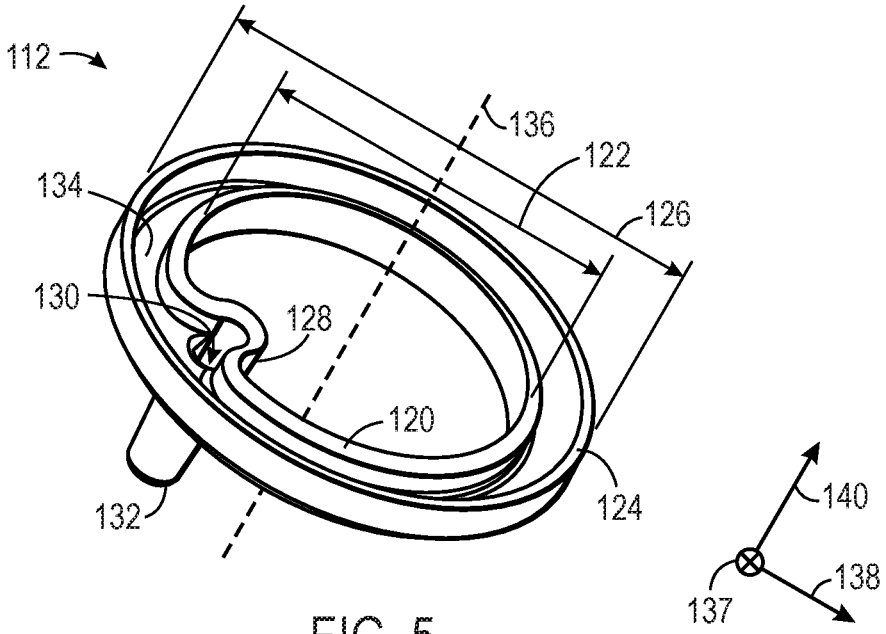
FIG. 5 is a top perspective view of a portion of the internal drain of FIG. 4 in accordance with an embodiment of the present disclosure.

An embodiment of the trough 112 of the internal drain 44 is shown in a top perspective view in FIG. 5. In the illustrated embodiment, the trough 112 includes an inner wall 120 with inner diameter 122, an outer wall 124 with outer diameter 126, an inner protrusion 128, an opening 130 in the inner protrusion 128, and a conical funnel 132 disposed below and coupled to the opening 130. The inner protrusion 128 in the illustrated embodiment is formed by a portion of the inner wall 120. Additionally, the inner protrusion 128 includes the opening 130 (e.g., is formed around the opening 130), which extends generally opposite the direction indicated by arrow 140 through the conical funnel 132. The conical funnel 132 may be a frustum.

Further, the inner wall 120 and the outer wall 124 extend upwardly from a base portion 134 of the trough 112, such that the inner wall 120, the outer wall 124, and the base portion 134 generally form a U-shaped profile that extends circumferentially around a longitudinal axis 136 of the trough 112 in a plane defined by the directions indicated by arrow 137, 138. As such, moisture or condensation 42 from inside the air intake 24 may fall or run into the trough 122 and, generally, collect on the base portion 134, such that the inner wall 120 and the outer wall 124 block the condensation 42 from escaping the trough 112. Further, the base portion 134 may direct the condensation 42 toward the opening 130 in the inner protrusion 128 of the trough 112. In certain embodiments, the base portion 134 may include a lower elevation at the opening 130 centered within the inner protrusion 128, such that the base portion 134 is tapered within the trough 112 downward toward the opening 130 (e.g., at the lower elevation). Accordingly, the condensation 42 may be directed via gravity toward the opening 130 centered within the inner protrusion 128, where the condensation 130 may enter the opening 130 and travel through the conical funnel 132 toward the tubing 62 (not shown). The tubing 62 may then direct the condensation 42, via gravity, to the drain pan 46, as previously described.

Figure 6:
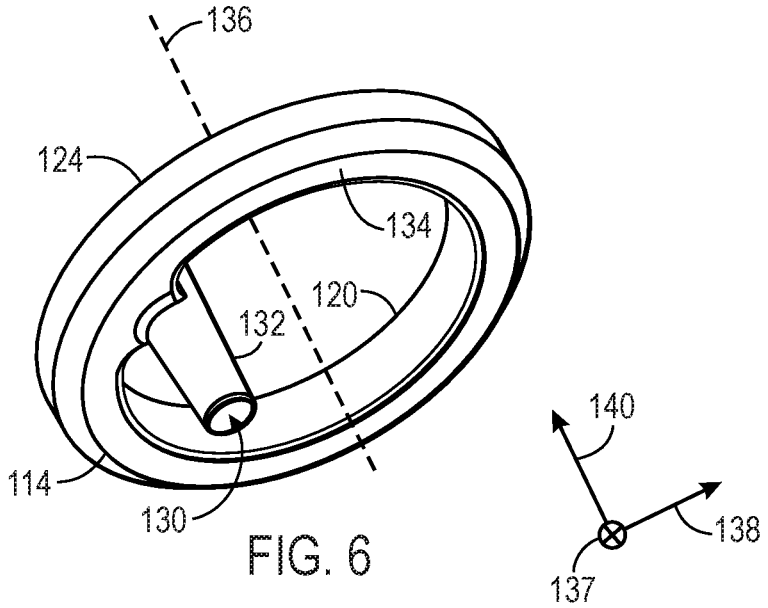
FIG. 6 is a bottom perspective view of the portion of the internal drain of FIG. 5 in accordance with an embodiment of the present disclosure.

An embodiment of the trough 112 of the internal drain 44 is shown in an additional perspective view in FIG. 6. In the illustrated embodiment the trough 112 includes the outer wall 124, the inner wall 120, and the base portion 134, which together form the substantially U-shaped profile extending circumferentially around the longitudinal axis 136, as previously described. Additionally, the base portion 134 includes the bottom surface 114. The bottom surface 114 may rest on the horizontal lip 110 of the lower cylinder 104 (not shown) of the seal component 92 of the air intake 24 when the internal drain 44 is installed. In other words, contact between the bottom surface 114 and the horizontal lip 110 may couple the trough 112 of the internal drain 44 to the air intake 24, such that the trough 112 rests on the horizontal lip 110 of the lower cylinder 104 of the seal component 92.

In the illustrated embodiment, the opening 130 in the base portion 134 of the trough 112 may extend through the conical funnel 132, such that condensation 42 travels from the base portion 134 of the trough 112 to the opening 130 in the inner protrusion 128, through the opening 130 extending through the conical funnel 132, and into the tubing 62 (not shown here) of the internal drain 44. The conical funnel 132 may be fit into or bonded to the tubing 62 via a friction fit, welding, brazing, adhesive, or some other type of bonding. Additionally, the conical funnel 132 may be a part of the tubing 62 (e.g., integral with the tubing 62), such that the tubing 62 is integrated with conical funnel 132 and, thus, the trough 112. Or, the tubing 62 and the conical funnel 132 may be a single part separate from the trough 112, and the conical funnel 132 may be coupled to the opening 130 in the trough 112 via the above described coupling techniques (e.g., friction fit, welding, brazing, adhesive, etc.). It should be noted that many modifications and changes regarding the connection(s) discussed above between the conical funnel 132, the tubing 62, the opening 130, and the trough 112 in general, may occur to those skilled in the art, and that such modifications and changes would not be considered as materially departing from the present disclosure.

Figure 7:
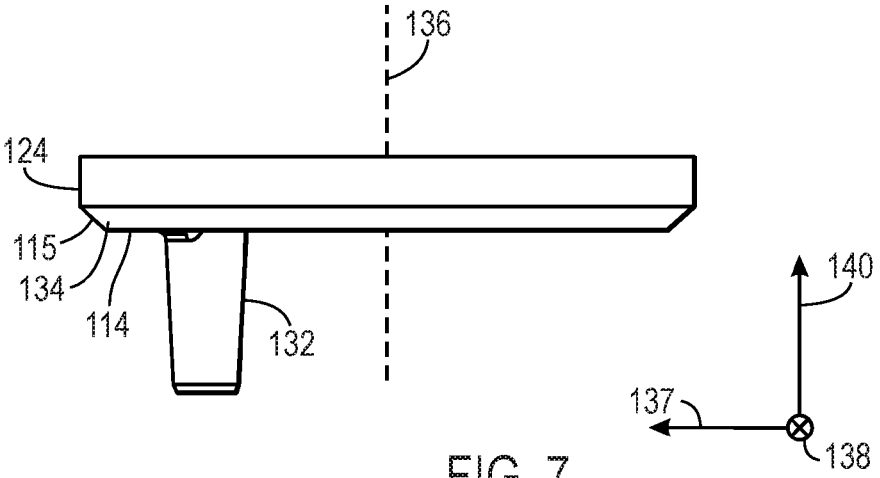
FIG. 7 is a right side view of the portion of the internal drain of FIG. 5 in accordance with an embodiment of the present disclosure.
Figure 8:
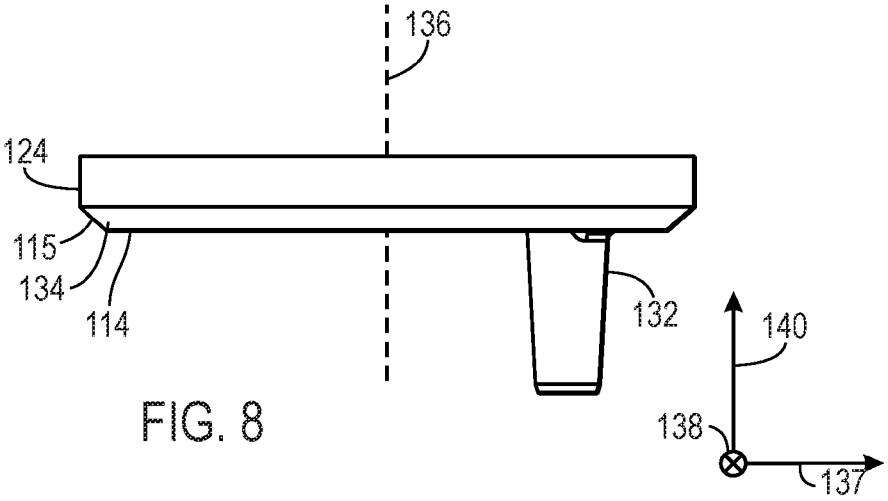
FIG. 8 is a left side view of the portion of the internal drain of FIG. 5 in accordance with an embodiment of the present disclosure.
Figure 9:
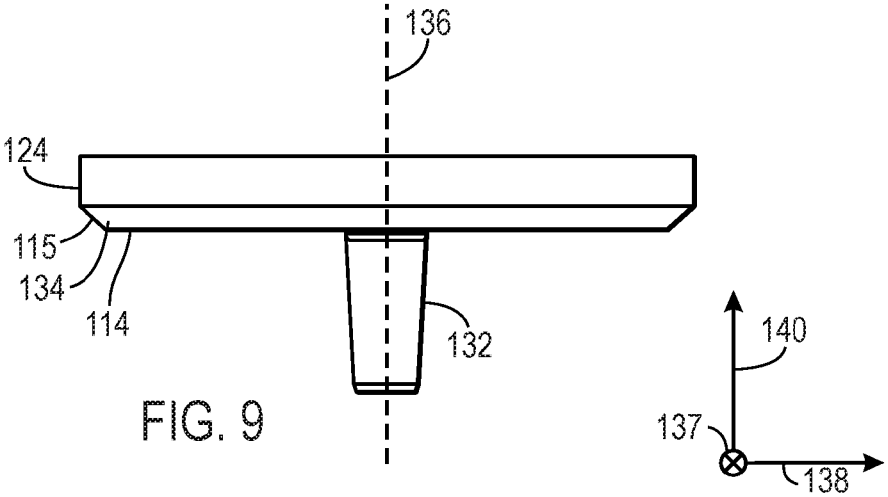
FIG. 9 is a front view of the portion of the internal drain of FIG. 5 in accordance with an embodiment of the present disclosure.
Figure 10:
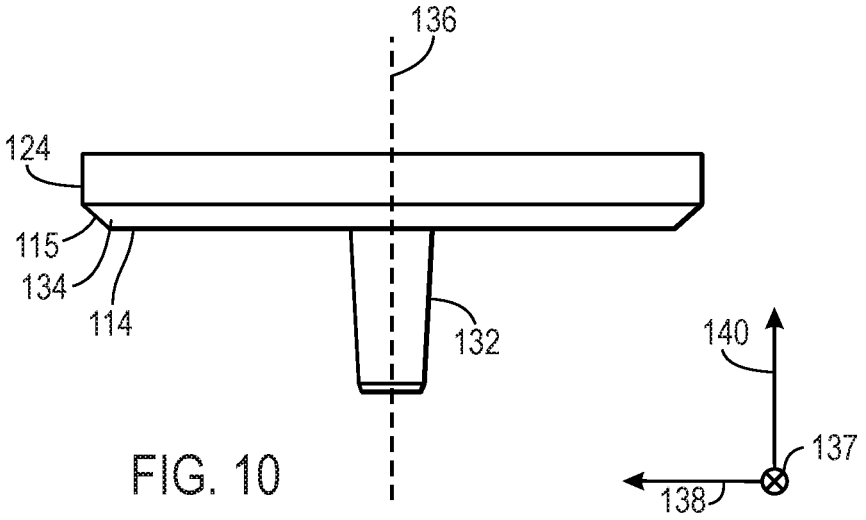
FIG. 10 is a back view of the portion of the internal drain of FIG. 5 in accordance with an embodiment of the present disclosure.

Side views of an embodiment of the trough 112 of the internal drain 44 are shown in FIGS. 7 and 8, and front and back views are shown in FIGS. 9 and 10. In the illustrated embodiments, the base portion 134 may be tapered at an angle from the outer wall 124 into the bottom surface 114 of the base portion 134. In other words, outside of the trough 112, the base portion may include a straight, angled edge 115 extending circumferentially around longitudinal axis 136 and extending between the outer wall 124 and the bottom surface 114 of the trough 112. In another embodiment, the base portion 134 may form a curve between the outer wall 124 and the bottom surface 114. In either configuration, the base portion 134 is configured to retain condensation 42 inside the trough 112, between the outer wall 124 and the inner wall 120 (not shown), and direct the condensation 42 toward the opening 130 and, thus, the conical funnel 132. The base portion 134 from inside of the trough 112 (e.g., between the inner wall 120 and the outer wall 124) may be a smooth, curved, U-shape profile, extending circumferentially around the longitudinal axis 136, for improved fluid (e.g., condensation 42) flow.

Figure 11:
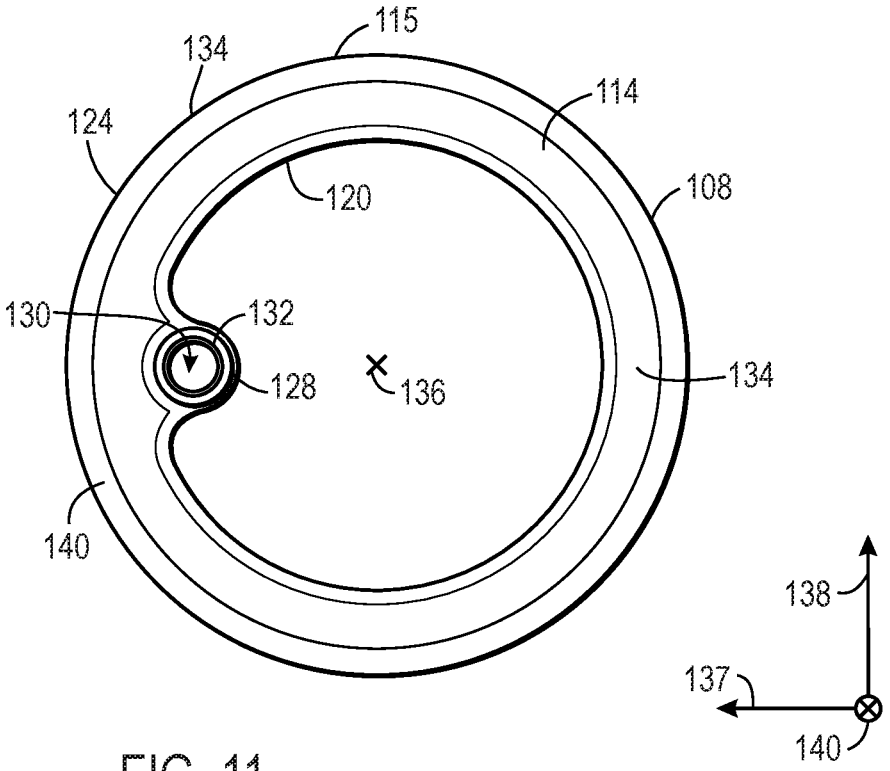
FIG. 11 is a bottom view of the portion of the internal drain of FIG. 5 in accordance with an embodiment of the present disclosure.
Figure 12:
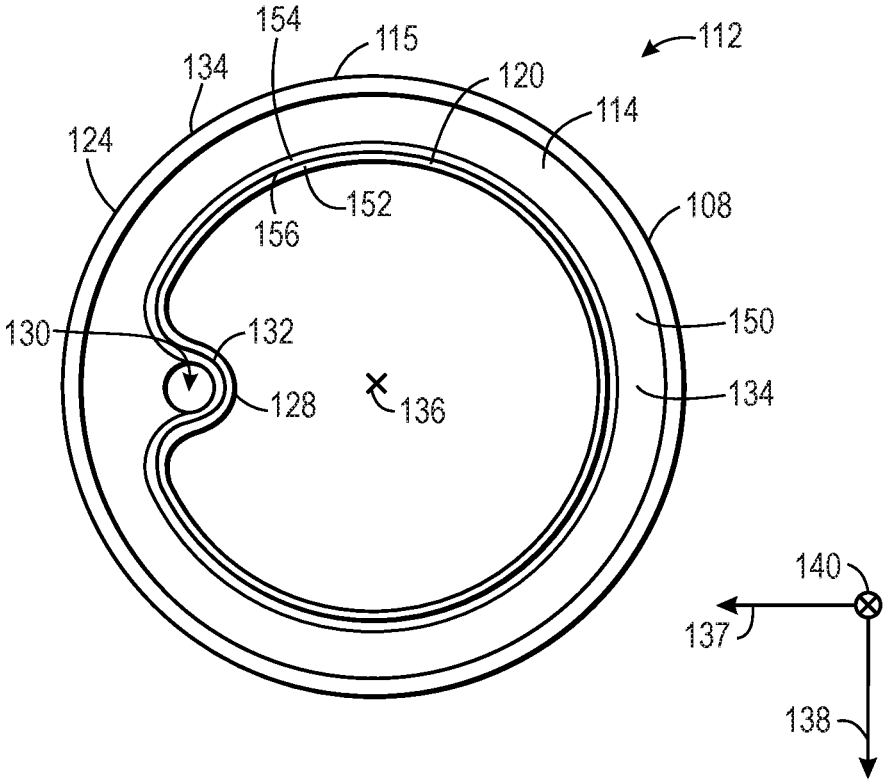
FIG. 12 is a top view of the portion of the internal drain of FIG. 5 in accordance with an embodiment of the present disclosure.

For example, bottom and top views of an embodiment of the trough 112 of the internal drain 44 are shown in FIG. 11 and FIG. 12, respectively. As shown in the illustrated embodiment in FIG. 11, the base portion 134 of the trough 112 is substantially smooth on the bottom surface 114 of the base portion 134, such that the bottom surface 114 may be sealed against the horizontal lip 110 of the lower cylinder 104 of the seal component 92, as previously discussed with respect to FIG. 4.

As illustrated in FIG. 12, the base portion 134 may extend between the outer wall 124 and the inner wall 120 of the trough 112. Additionally, inside the trough 112, the base portion 134 may be a smooth, curved, U-shape profile extending circumferentially around the longitudinal axis 136. In other words, a top surface 150 of the base portion 134 (e.g., from inside the trough 112) may be a smooth, curved, U-shape profile extending circumferentially around the longitudinal axis 136, while the base portion 134 (e.g., from outside the trough 112) may include the angled edge 115 and the bottom surface 114, as previously described, where the angled edge 115 extends between the outer wall 124 and the bottom surface 114 and extends circumferentially around the longitudinal axis 136. In some embodiments, the top surface 150 may slope toward the opening 130, such that condensation gathered on the top surface 150 within the trough 112 may be guided toward the opening 130.

The trough 112 in the illustrated embodiment includes the inner wall 120 configured as a pointed edge. In other words, the inner wall 120 in the illustrated embodiment includes a radially inner face 152, a radially outer face 154, and a pointed edge 156. The radially inner face 152 and the radially outer face 154 are circumferentially centered about the longitudinal axis 136, and the radially inner face 152 and radially outer face 154 meet at the pointed edge 156. In another embodiment, the inner wall 120 may include a flat top between two angled surfaces, the inner wall 120 may be a curved shape, or the inner wall 120 may include a steep angle with a pinnacle as the innermost edge relative to the axis 136, e.g., a beveled face as an upper edge. Including an angled face of the inner wall 120 that slopes toward the trough 112 may facilitate guiding any liquid that comes into contact with the face into the trough 112 for draining. It should be noted that many modifications and changes regarding the shape of the inner wall 120 (and the outer wall 124) may occur to those skilled in the art, and that such modifications and changes would not be considered outside the scope of the present disclosure. The inner and outer walls 120, 124 are configured to retain condensation 42 collected on the top surface 150 of the base portion 134, such that the base portion 134 may channel the condensation 42 toward the opening 130 that extends through the top surface 150, the inner protrusion 128, the bottom surface 114, and the conical funnel 132. The condensation 42 may be funneled through the conical funnel 132 below the opening 130 toward the tubing 62 (not shown), as previously described, such that the condensation 42 may be drained to the drain pan 46 (not shown).

Figure 13:
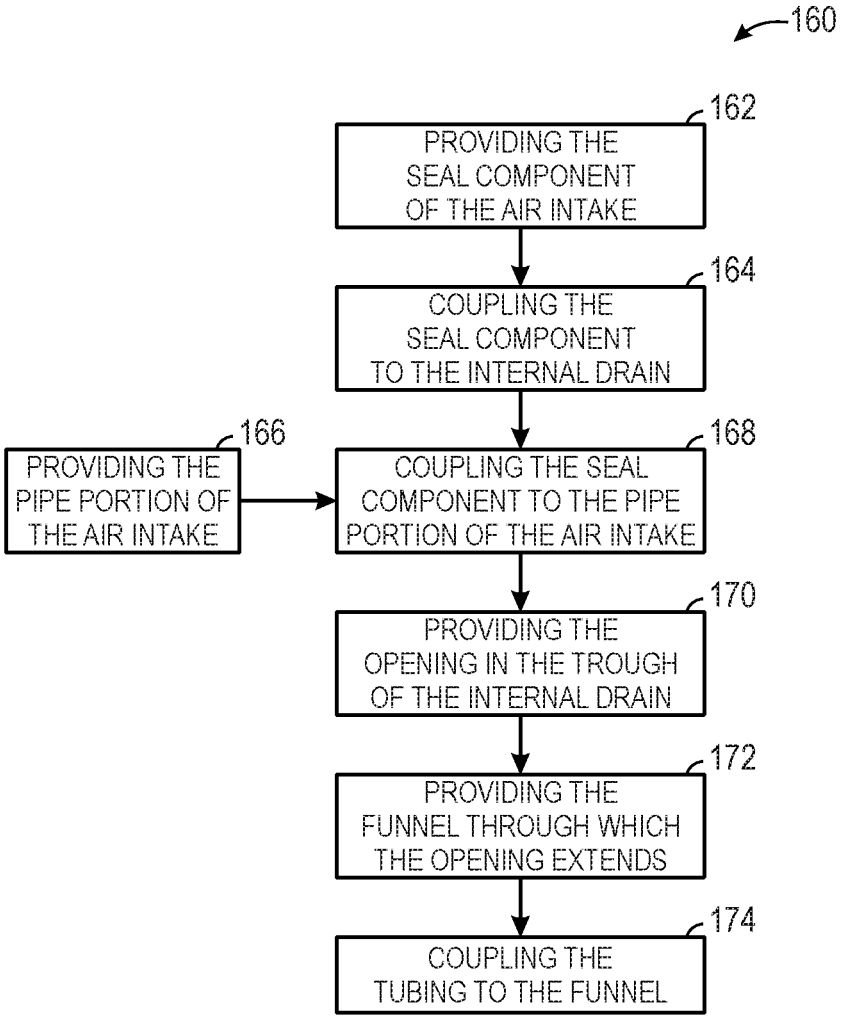
FIG. 13 is a process flow diagram of a method of manufacturing an air intake with an internal drain in accordance with an embodiment of the present disclosure.

Turning now to FIG. 13, a method 160 of manufacturing the air intake 24 with the internal drain 44 is illustrated, in accordance with the present disclosure, in a process flow diagram. In the illustrated embodiment, the method 160 includes providing the seal component 92 of the air intake 24, as shown in block 162. The seal component 92 is coupled to the internal drain 44, as indicated by block 164, such that the internal drain 44 is inside the air intake 24. The internal drain 44 may be coupled to an internal feature (e.g., the horizontal lip 110) of the seal component 92, as previously described. Further, the pipe portion 90 of the air intake 24 is provided, as indicated by block 166, such that the pipe portion 90 may be coupled to the seal component 92 of the air intake 24, as indicated by block 168. The opening 130 is be provided in a trough 112 of the internal drain 24, as shown in block 170, such that condensation 42 may flow from the trough 112 and through the opening 130. As represented by block 172, the funnel 132 of the internal drain 44 is provided, through which the opening 130 extends. Additionally, as shown in block 174, the tubing 62 is coupled to the funnel 132 and disposed inside a portion of the air intake 24 (e.g., the seal component 92), such that the condensation 42 may flow through the tubing 62 internal to the portion of the air intake 24 to an area external to the air intake 24.

As discussed in detail above, embodiments of the present disclosure are directed toward the furnace system 10 and the internal drain 44 of the air intake 24 of the furnace system 10. For example, the internal drain 44 may drain the condensation 42 collected in the air intake 24 internal to the air intake 24, such that the condensation 42 is blocked from damaging electronics and/or other components of the furnace system 10.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A furnace system, comprising:
   - an air intake having a pipe portion;
   - a seal component of the air intake configured to couple with the pipe portion;
   - an internal drain configured to be disposed internal to the air intake, supported at least in part by the seal component, and comprising a trough configured to collect liquid condensate flowing along an inner surface of the pipe portion, an inner surface of the seal component, or both; and
   - an opening in the trough configured to guide the liquid condensate collected in the trough toward a location outside the air intake.

2. The furnace system of claim 1, wherein the trough comprises a U-shaped cross-section.

3. The furnace system of claim 1, wherein the trough is configured to be positioned between the pipe portion and the seal component along a flow path of the air intake.

4. The furnace system of claim 1, wherein the seal component comprises a broad segment and a narrow segment that cooperate to define an internal ledge.

5. The furnace system of claim 4, wherein a base of the trough of the internal drain is configured to rest on the internal ledge, and is configured to be positioned between the internal ledge and the pipe portion.

6. The furnace system of claim 1, wherein the internal drain is configured to be disposed within the pipe portion.

7. The furnace system of claim 1, wherein an inner diameter of the pipe portion is configured to be aligned between inner edges of walls defining the trough.

8. The furnace system of claim 1, comprising a combustion air blower configured to draw air into a combustion chamber through the air intake.

9. An internal drain for an air intake of a combustion air blower of a furnace system, comprising:
   - a trough;
   - a funnel; and
   - a tube, wherein the trough is configured to be located internal to the air intake, wherein the trough is configured to collect liquid condensate flowing along an inner surface of the air intake and to pass the liquid condensate through the funnel to the tube, wherein the tube is configured to route the liquid condensate through the air intake to an area outside of the air intake, and wherein the funnel is directly coupled to the tube.

10. The internal drain of claim 9, comprising an inner and an outer wall defining the trough, wherein the inner wall includes a protrusion that is configured to extend around an opening into the funnel through a base of the trough.

11. The internal drain of claim 9, comprising an inner and an outer wall defining the trough, wherein the inner wall comprises a beveled face as an upper edge.

12. The internal drain of claim 9, wherein the funnel comprises a frustum.

13. The internal drain of claim 9, comprising a seal configured to be disposed about the trough, configured to retain the trough, and configured to couple with a pipe portion of the air intake.

14. The internal drain of claim 9, wherein the funnel and tube are integrally formed as a single component.

15. The internal drain of claim 9, comprising a sloped or curved portion between an outer wall of the trough and a bottom surface of the trough.

16. A system, comprising:

an air intake;

a pipe portion of the air intake;

a drain of the air intake, wherein the drain comprises a trough extending circumferentially about a longitudinal axis to form a circle and configured to collect liquid condensate flowing along the pipe portion; and an opening in the trough configured to guide the liquid condensate from the trough to a tube extending outside the pipe portion of the air intake, wherein the opening in the trough is offset from the longitudinal axis.

17. The system of claim 16, comprising a seal component that retains the drain of the air intake within the air intake.

18. The system of claim 17, wherein the drain is disposed between the pipe portion and the seal component.

19. The system of claim 17, wherein the drain is disposed on an internal ledge of the seal component.

20. The system of claim 16, wherein the pipe portion comprises a conduit disposed about the trough.

21. The system of claim 16, comprising a combustion air blower that draws air into a combustion chamber through the air intake.

22. The system of claim 16, wherein the trough comprises a U-shaped cross-sectional profile extending circumferentially about the longitudinal axis to form the circle and configured to collect the liquid condensate.

* * * * *